US011196192B2

(12) United States Patent
Watkins et al.

(10) Patent No.: US 11,196,192 B2
(45) Date of Patent: Dec. 7, 2021

(54) COAXIAL CABLE CONNECTORS HAVING A GROUNDING MEMBER

(71) Applicant: PPC BROADBAND, INC., East Syracuse, NY (US)

(72) Inventors: Harold Watkins, Chittenango, NY (US); Steve Stankovski, Clay, NY (US); Richard Maroney, Camillus, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/701,147

(22) Filed: Dec. 2, 2019

(65) Prior Publication Data

US 2020/0381877 A1 Dec. 3, 2020

Related U.S. Application Data

(60) Provisional application No. 62/773,801, filed on Nov. 30, 2018.

(51) Int. Cl.

| | |
|---|---|
| ***H01R 9/05*** | (2006.01) |
| ***H01R 24/40*** | (2011.01) |
| ***H01R 13/622*** | (2006.01) |
| ***H01R 13/187*** | (2006.01) |

(52) U.S. Cl.

CPC ..... *H01R 9/05* (2013.01); *H01R 9/0521* (2013.01); *H01R 13/187* (2013.01); *H01R 13/622* (2013.01); *H01R 24/40* (2013.01)

(58) Field of Classification Search

CPC .. H01R 13/622; H01R 2103/00; H01R 24/40; H01R 9/0524; H01R 24/38; H01R 9/05; H01R 13/187

USPC ..... 439/578, 321, 322, 385, 584

See application file for complete search history.

(56) References Cited

U.S. PATENT DOCUMENTS

| | | | | |
|---|---|---|---|---|
| 7,097,499 | B1 | 8/2006 | Purdy | |
| 7,189,091 | B1 * | 3/2007 | Montena | H01R 9/0521 439/322 |
| 7,892,005 | B2 * | 2/2011 | Haube | H01R 24/40 439/321 |
| 7,938,680 | B1 | 5/2011 | Hsieh | |

(Continued)

FOREIGN PATENT DOCUMENTS

JP 2007122929 A * 5/2007 ..... H01R 24/02

OTHER PUBLICATIONS

English Translation of JP 2007122929A (Year: 2007).*

(Continued)

*Primary Examiner* — Edwin A. Leon
*Assistant Examiner* — Matthew T Dzierzynski
(74) *Attorney, Agent, or Firm* — MH2 Technology Law Group LLP

(57) ABSTRACT

A coupler for a coaxial cable connector includes a nut including an internally threaded portion and an extension portion extending forwardly from the threaded portion; and a grounding cage slidingly coupled with the nut. An inner surface of the extension portion includes an annular groove, the grounding cage includes a rear ring portion disposed in the annular groove and configured to slide in the annular groove, and a forward portion of the grounding cage is configured to extend forwardly beyond a forward end of the nut.

23 Claims, 3 Drawing Sheets

(56) References Cited

U.S. PATENT DOCUMENTS

| | | | | |
|---|---|---|---|---|
| 8,506,325 | B2 * | 8/2013 | Malloy | H01R 24/40 439/578 |
| 9,048,599 | B2 * | 6/2015 | Burris | H01R 9/05 |
| 9,130,281 | B2 * | 9/2015 | Phillips, Jr. | H01R 9/0524 |
| 9,543,691 | B2 * | 1/2017 | Watkins | H01R 13/5221 |
| 9,653,823 | B2 * | 5/2017 | Eriksen | H01R 9/0524 |
| 10,622,749 | B2 * | 4/2020 | Watkins | H01R 13/622 |
| 2012/0094532 | A1 | 4/2012 | Montena | |
| 2013/0323967 | A1 | 12/2013 | Wood | |
| 2018/0054017 | A1 | 2/2018 | Watkins et al. | |
| 2019/0074610 | A1 * | 3/2019 | Thakare | H01R 9/0527 |
| 2019/0379146 | A1 * | 12/2019 | Thakare | H01R 9/0527 |

OTHER PUBLICATIONS

Search Report dated Feb. 18, 2020 in corresponding International Application No. PCT/US2019/064080, 2 pages.

Written Opinion dated Feb. 18, 2020 in corresponding International Application No. PCT/US2019/064080, 3 pages.

International Preliminary Report on Patentability dated May 25, 2021 in corresponding International Application No. PCT/US2019/064080, 4 pages.

* cited by examiner

COAXIAL CABLE CONNECTORS HAVING A GROUNDING MEMBER

CROSS-REFERENCE TO RELATED APPLICATION

This nonprovisional application claims the benefit of U.S. Provisional Application No. 62/773,801, filed Nov. 30, 2018, the content of which is incorporated herein by reference in its entirety.

BACKGROUND

Coaxial cables are often used for communicating signals in broadband applications. Since transmission lines naturally create electromagnetic fields when electricity flows through them, an advantage of using coaxial cables, as opposed to other types of transmission lines, is that the coaxial cables are designed such that the electromagnetic fields are contained within the coaxial cables themselves and do not extend outside the cables. Thus, coaxial cables do not create electromagnetic fields that could potentially interrupt external circuits. In addition, even if coaxial cables are installed next to metal objects, they provide protection of the communications signals from external electromagnetic interference without a loss of power that may occur in other transmission lines.

By installing coaxial cable connectors at the ends of the coaxial cables, the coaxial cables can be connected to other cables or broadband devices. A coaxial cable connector typically includes an internally threaded nut for connection to an externally threaded interface port. A grounding post typically attaches an outer grounding conductor of the coaxial cable with the nut. A coaxial cable is normally stripped to expose a center conductor, which carries the electrical signals, such that the center conductor extends a short distance beyond the end of the nut. Tightening the threaded connection of the coaxial cable connector to the interface port helps to ensure a ground connection between the connector and the corresponding interface port.

During a connection process, the center conductor of a coaxial cable is inserted into a female receptor of the interface port and then the nut is screwed onto the post. A potential problem with this connection process is that some equipment may respond in an undesirable manner if connection is made between the electrically active components of the coaxial cable and interface port before the grounding components are connected.

Thus, in some environments, it may be desirable that the grounding contacts are connected first to provide proper grounding before the signal-carrying center conductors of the coaxial cables are electrically connected to other equipment. Lack of continuous port grounding in a conventional threaded connector, for example, may introduce noise and degrade the performance of conventional RF systems. Furthermore, lack of ground contact prior to the center conductor contacting the interface port may also introduce an undesirable "burst" of noise upon insertion of the center conductor into the interface port.

Accordingly, there is a need to overcome, or otherwise lessen the effects of, the disadvantages and shortcomings described above. Hence a need exists for a coaxial cable connector having improved ground conductivity between the coaxial cable, the connector, and the interface port.

BRIEF DESCRIPTION OF THE DRAWINGS

Features and advantages of the present disclosure are described in, and will be apparent from, the following description.

DETAILED DESCRIPTION OF EMBODIMENTS

The accompanying figures illustrate various exemplary embodiments of coaxial cable connectors that provide improved ground continuity between the coaxial cable, the connector, and the coaxial cable connector interface port. Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 8:
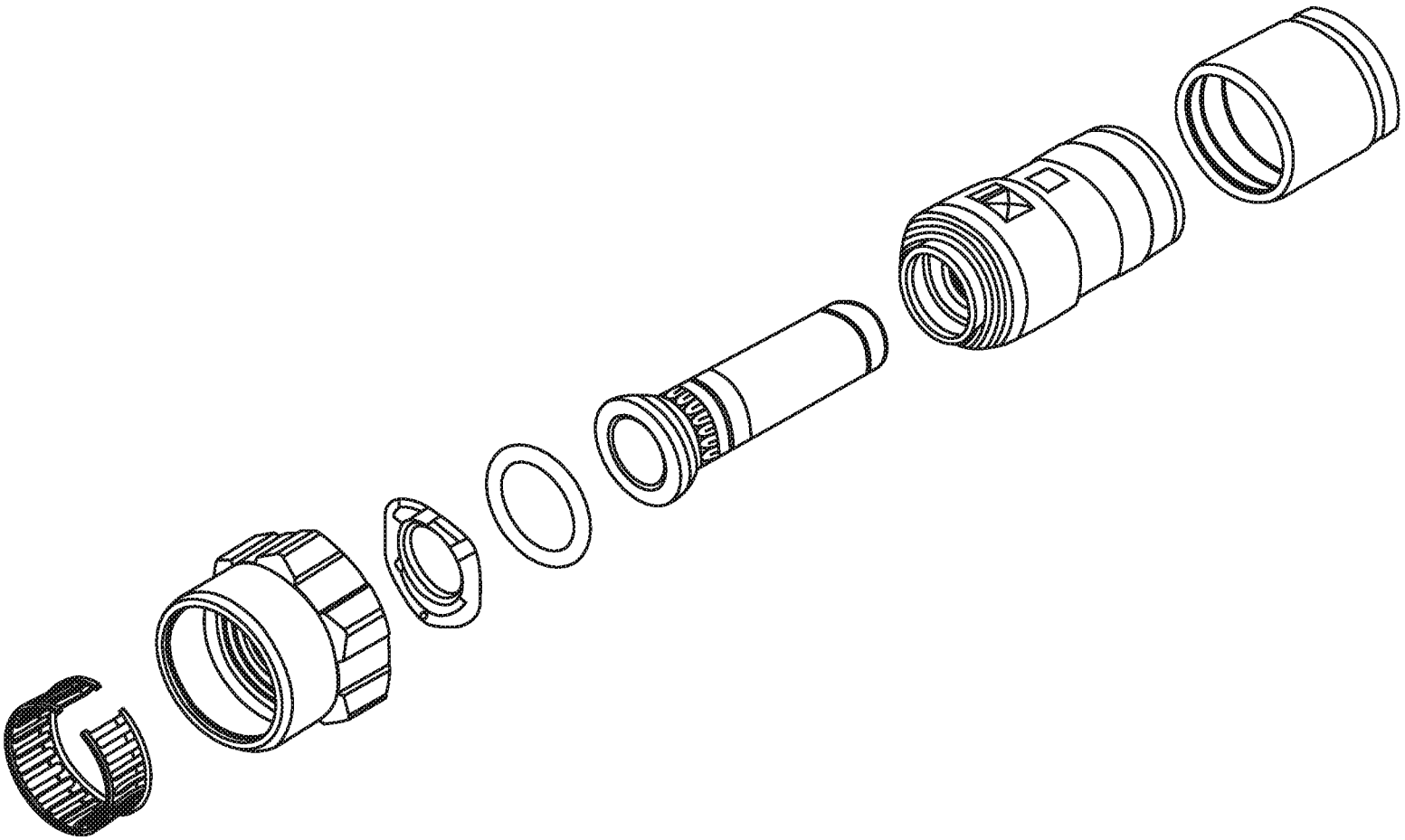
FIG. 8 is an exploded perspective view of the exemplary coaxial cable connector of FIG. 5.

Referring to the drawings, FIG. 8 depicts a coaxial cable connector 1. The coaxial cable connector 1 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 8 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 8, the connector 1 may be configured to be coupled with a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's operable electrical interface with the connector 1. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 8, the conventional coaxial cable connector 1 may include a coupler 30, a post 40, a connector body 50, a fastener member 60, a grounding member 70 formed of conductive material, and a connector body sealing member 80, such as, for example, a body O-ring configured to fit around a portion of the connector body 50. The nut 30 at the front end of the post 40 serves to attach the connector 1 to an interface port. The general arrangement, assembly, and function of the post, the connector body, the fastener member 60, the grounding member 70, and the connector body sealing member 80 are described in numerous patents and published applications, including U.S. patent application Ser. No. 15/682,538 (USPAP 2018/0054017), the disclosure of which is incorporated herein by reference.

Figure 5:
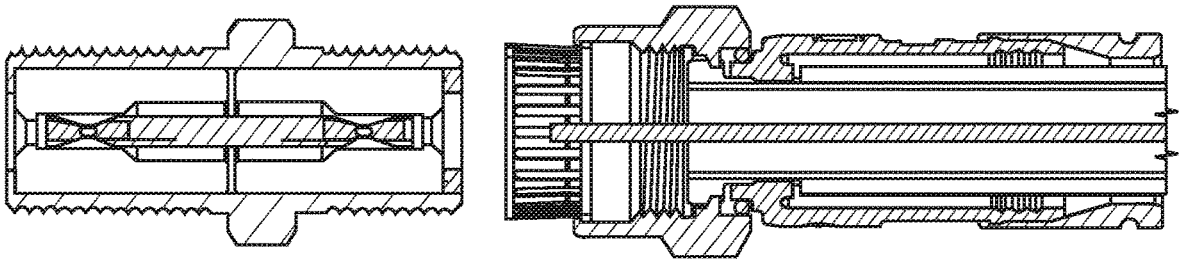
FIG. 5 is a side cross-sectional view of an exemplary coaxial cable connector including the exemplary coupler of FIG. 1 prior to coupling with an interface port.
Figure 6:
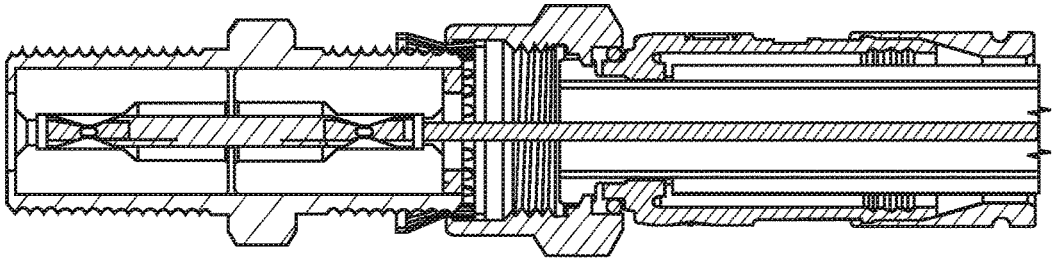
FIG. 6 is a side cross-sectional view of the exemplary coaxial cable connector of FIG. 5 at an intermediate stage of coupling with the interface port.
Figure 7:
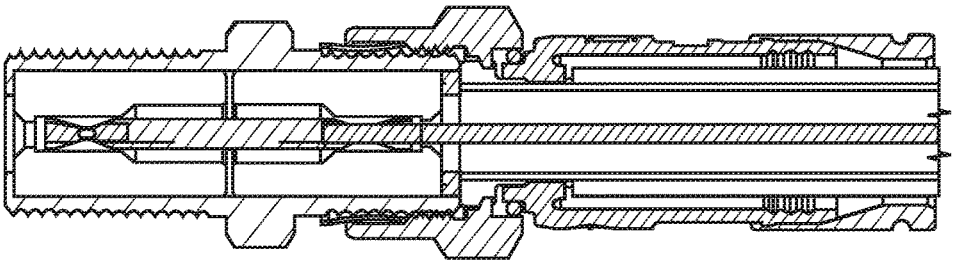
FIG. 7 is a side cross-sectional view of the exemplary coaxial cable connector of FIG. 5 at an end stage of coupling with the interface port.

Referring now to FIGS. 1-4, the coupler 30 includes a nut portion 31, an extension portion 32, and a cage 33. The cage 33 includes a rear ring 331, a forward ring 332, and a plurality of slats 333 extending from the forward ring 332 to the rear ring 331. As shown, the front ring 332 and the rear ring 331 do not form a complete circle such that a circumferential opening 334 exists between opposing free ends of the front ring 332 and opposing free ends of the rear ring 331. As best shown in FIGS. 5-7, the extension portion 32 includes an annular internal lip 321 at a forward end 34 of the extension portion 32 that extends radially inward. The nut portion 31 includes internal threads 311 configured to be coupled with the threaded surface 23 of the interface port 20. A forward end 312 of the internal threads 311 cooperates with the internal lip 321 to define an annular slot 322 in the extension region 32 that is configured to receive the rear ring 331 of the cage 33.

As described below with respect to FIG. 8, the coupler is electrically connected to the grounding conductor of the coaxial cable 10. Also, the cage 33 is electrically connected to the extension portion 32, which in turn is electrically connected to the nut portion 31. Thus, the cage 33 is held at substantially the same ground potential as the grounding conductor of the coaxial cable 10.

The cage 33 is formed such that before it is installed in the extension portion 32, the cage 33 has a diameter that is greater than an inner diameter of the extension portion 32. Thus, to install the cage 33 in the extension portion 32, an inwardly collapsing force is applied to the cage 33 to allow at least the rear ring 331 of the cage 33 to be inserted within the interior slot 322 of the extension portion 32. When the cage 33 is installed in the extension portion 32, the cage 33 exerts a radially-outward biasing force on the inner surface of the extension portion 32 at a forward end of the interior slot 322 near the internal lip 321 to substantially hold the cage 33 in place.

The circumferential openings 334 allow the cage to have a radial force when it is installed in the extension portion 32. With the rear ring 331 of the cage 33 inside the extension portion 32 and the forward ring 332 outside the extension, the cage 33 will tend to push out axially from the extension portion 32 in the forward direction. When not connected to the interface port 20, the cage 33 will have a forward active position. When the cage 33 makes contact with the interface port 20, the radial contact force on the cage 33 by the interface portion 20 will tend to move the cage 33 further inside the extension portion 32. The ability to move within the extension portion 32 improves the dynamic range of the cage 33 to facilitate a greater range of interface port sizes.

Figure 1:
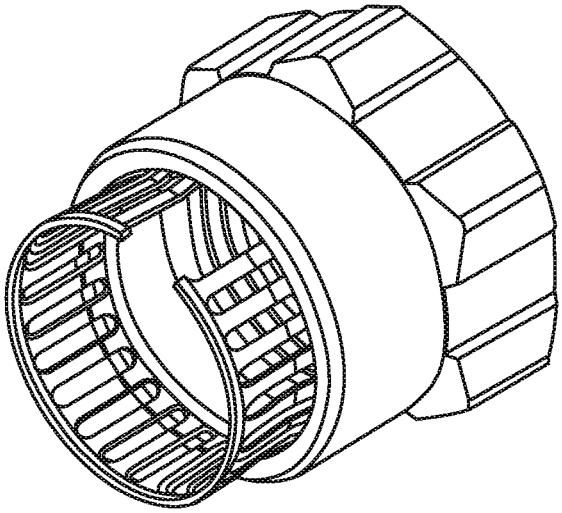
FIG. 1 is a perspective view of an exemplary coupler for use with a coaxial cable connector in accordance with various aspects of the disclosure.
Figure 2:
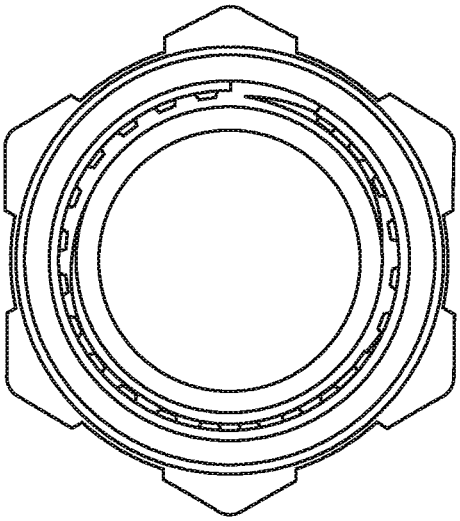
FIG. 2 is a front view of the exemplary coupler of FIG. 1.
Figure 3:
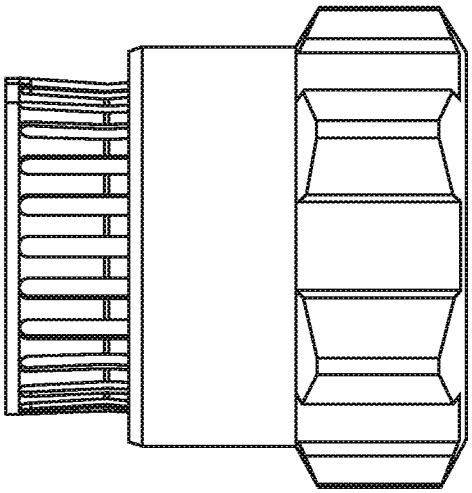
FIG. 3 is a side view of the exemplary coupler of FIG. 1.
Figure 4:
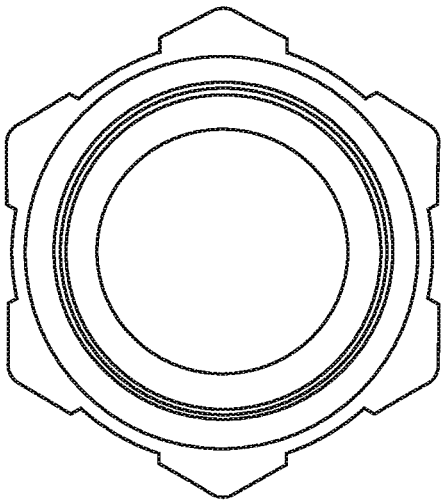
FIG. 4 is a rear view of the exemplar coupler of FIG. 1.

Each of the slats 333 of the cage 33 may include a curve that bends inwardly between the forward and rearward ends of the slats 333. In other words, as best illustrated in FIGS. 3 and 5, from a first end of the slats 333 (e.g., the end connected to the rear ring 331), the slats 333 are angled slightly toward a central axis of the cage 33 and then are angled slightly outwardly from the central axis to the other end of the slats 333 (e.g., the end connected to the forward ring 332). With this arrangement, the rear ring 331 and back portions of the slats 333 can be confined within the interior space of the extension portion 32 and can be limited in a forward direction by the forward internal lip 321 of the extension portion 32. Also, by extending slightly outward in the forward portion of the cage 33, the slats 333 of the cage 33 are able to be installed more easily on a corresponding port 20 to which the connector 1 is to be connected.

FIGS. 5-7 illustrate cross-sectional side views of the connector land a corresponding port 20 to which the connector 1 is to be connected in order to demonstrate how the connector 1 is installed on the interface port 20. The connector 1 is shown in a condition after it has been installed on the end of a coaxial cable 10, as described with respect to FIG. 8.

In FIG. 5, no contact has yet been made between the connector 1 of the coaxial cable and the interface port 20. In many conventional coaxial cable connectors, the center conductor 18 extends forward beyond a front end of the nut such that the center conductor will first make contact with an electrical contact within a female receptacle before the nut makes electrical grounding contact with the grounded outer shell of the interface port. However, according to the embodiments of the connector 1 described in the present disclosure, the cage 33 makes grounding contact with the interface port 20 before the center conductor 18 makes contact with the terminal 25 of the port's female receptacle.

The cage 33 of the connector 1 protrudes from the extension portion 32 beyond the end of the center conductor 18. Thus, when the connector 2 is first connected with the interface port 20, as shown in FIG. 6, the forward ring 332 and/or the inside portions of the slats 333 of the cage 33 contact the threaded surface 23 of the end of the interface port 20. When pushed onto the port 20, the cage 33 moves rearward inside the extension portion 32 toward the nut portion 31, which increases the contact pressure on the port 20 by the cage 33.

This grounding contact point of the connector 1 is maintained in front of the center conductor 18 when contact is first made. With pressure applied to move the nut portion 31 toward the interface port 31, the rear ring 331 of the cage 33 moves rearward inside the extension portion 32 toward a rear stop of the extension portion 32 formed by a forward end 312 of the internal threads 311.

An inner surface of the extension portion 32 forms the inner annular slot 322 that defines an area where the rear ring 331 of the cage 33 can move. The inner surface of the extension includes the forward lip 321 and the rear stop 312. The rear ring 331 of the cage 33 is confined to move between the forward lip 321 and the rear stop 312. The smallest diameter of the forward lip 321 is greater than the largest diameter of the external threads 23 of the interface port 20. Thus, the slats 333 of the cage 33 are confined within a radial space between the inner surface of the forward lip 321 and the outer surface of the threads 23 of the interface port 20, as shown in FIG. 6.

When the coupler 30 continues to move toward the port 20, the force applied by the port 20 to the cage 33 causes the cage 33 to move along the inner annular slot 322 at the inner surface of the extension portion 32 from the forward lip 321 toward the rear stop 312. Thus, constant grounding contact is made between the coupler 30 and the interface port 20 while the coupler 30 is being connected to the port 20.

As shown in FIG. 7, the cage 33 continues to slide within the extension portion 32 during connection until the rear ring 312 meets the rear stop 312. Because of the bent shape of the slats 333 of the cage 30, the slats 333 are pressed between the extension portion 32 and the port 20 to maintain a grounding potential to the ground conductor of the coaxial cable 10.

When the coupler 30 is moved further toward the interface port 20, the internal threads of the nut portion 31 contact the external threads 23 of the port 20. With a twisting action on the nut and continued force toward the port, the internal threads of the nut portion 31 engage the external threads 23 of the port 20. Therefore, ground contact is maintained via the cage 33 throughout the process of connecting the nut portion 31 to the port 20, even before the internal threads 311 of the nut portion 31 make contact with or are engaged with the external threads 23 of the port 20. The action of maintaining ground contact between the connector 1 and the port 20, as is possible with the embodiments of the present disclosure, overcomes the problems mentioned above with respect to conventional connectors.

Also, female port lengths may vary in the field. For example, some port lengths may be ⅜" while others may be ½", making it more difficult for conventional connectors to accommodate both lengths. However, according to the embodiments of the present disclosure, the connectors are able to work well with both lengths to establish grounding contact before contact of signal-carrying conductors.

FIG. 8 depicts a coaxial cable connector including the cage, nut, and extension as described in the present disclosure. The coaxial cable connector may be operably affixed, or otherwise functionally attached, to a coaxial cable (not shown in FIG. 8) having a protective outer jacket, a conductive grounding shield, an interior dielectric, and a center conductor.

The coaxial cable may be prepared by removing the protective outer jacket and drawing back the conductive grounding shield to expose a portion of the interior dielectric. Further preparation of the embodied coaxial cable may include stripping the dielectric to expose a portion of the center conductor. The protective outer jacket is intended to protect the various components of the coaxial cable from damage which may result from exposure to dirt or moisture and from corrosion. Moreover, the protective outer jacket may serve in some measure to secure the various components of the coaxial cable in a contained cable design that protects the cable from damage related to movement during cable installation.

The conductive grounding shield of the coaxial cable may be comprised of conductive materials suitable for providing an electrical ground connection, such as cuprous braided material, aluminum foils, thin metallic elements, or other like structures. Various embodiments of the shield may be employed to screen unwanted noise. For instance, the shield may comprise a metal foil wrapped around the dielectric, or several conductive strands formed in a continuous braid around the dielectric. Combinations of foil and/or braided strands may be utilized wherein the conductive shield may comprise a foil layer, then a braided layer, and then a foil layer. Those in the art will appreciate that various layer combinations may be implemented in order for the conductive grounding shield to effectuate an electromagnetic buffer helping to prevent ingress of environmental noise that may disrupt broadband communications.

The dielectric of the coaxial cable may be comprised of materials suitable for electrical insulation, such as plastic foam material, paper materials, rubber-like polymers, or other functional insulating materials.

It should be noted that the various materials of which all the various components of the coaxial cable are comprised should have some degree of elasticity allowing the cable to flex or bend in accordance with traditional broadband communication standards, installation methods and/or equipment. It should further be recognized that the radial thickness of the coaxial cable, protective outer jacket, conductive grounding shield, interior dielectric and/or center conductor may vary based upon generally recognized parameters corresponding to broadband communication standards and/or equipment.

Referring further to FIG. 8, the coaxial cable connector may be configured to be coupled with the coaxial cable interface port shown in FIGS. 5-7. The coaxial cable interface port includes a conductive receptacle for receiving a portion of a coaxial cable center conductor sufficient to make adequate electrical contact. The coaxial cable interface port may further comprise a threaded exterior surface. It should be recognized that the radial thickness and/or the length of the coaxial cable interface port and/or the conductive receptacle of the port may vary based upon generally recognized parameters corresponding to broadband communication standards and/or equipment. Moreover, the pitch and height of threads which may be formed upon the threaded exterior surface of the coaxial cable interface port may also vary based upon generally recognized parameters corresponding to broadband communication standards and/or equipment. Furthermore, it should be noted that the interface port may be formed of a single conductive material, multiple conductive materials, or may be configured with both conductive and non-conductive materials corresponding to the port's operable electrical interface with the connector. However, the receptacle of the port should be formed of a conductive material, such as a metal, like brass, copper, or aluminum. Further still, it will be understood by those of ordinary skill that the interface port may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 8, the coaxial cable connector may include a coupler (e.g., the threaded nut), a post, a connector body, a fastener member, a continuity member formed of conductive material, and a seal, such as, for example, a body O-ring configured to fit around a portion of the connector body. The nut at the front end of the post serves to attach the connector to the interface port.

The nut of the coaxial cable connector has a first forward end defining the extension and an opposing second rearward end. The nut may comprise internal threading near the second rearward end, as shown in FIGS. 5-7, extending a distance sufficient to provide operably effective threadable contact with the external threads of the coaxial cable interface port. The extension includes the forward lip, such as an annular protrusion, located proximate the second rearward end of the nut. The forward lip includes a surface facing a first forward end of the extension. The forward facing surface of the lip may be a tapered surface or side facing the first forward end of the extension.

The structural configuration of the nut/extension may vary according to differing connector design parameters to accommodate different functionality of a coaxial cable connector. For instance, the nut/extension may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end of a nut, when mated with the interface port. Moreover, the second rearward end of the nut may extend a significant axial distance to radially extend, or otherwise partially surround, a portion of the connector body, although the extended portion of the nut need not contact the connector body.

The nut/extension may be formed of conductive materials, such as copper, brass, aluminum, or other metals or metal alloys, facilitating grounding through the nut. Accordingly, the nut/extension may be configured to extend an electromagnetic buffer by electrically contacting conductive surfaces of the interface port when the connector is advanced onto the port. In addition, the nut/extension may be formed of both conductive and non-conductive materials. For example, the external surface of the nut may be formed of a polymer, while the remainder of the nut may be comprised of a metal or other conductive material. The nut/extension may be formed of metals or polymers or other materials that would facilitate a rigidly formed nut body.

Manufacture of the nut/extension may include casting, extruding, cutting, knurling, turning, tapping, drilling, injection molding, blow molding, combinations thereof, or other fabrication methods that may provide efficient production of the component. As shown in FIGS. 5-7, a forward facing portion of the nut faces a flange of the post when operably assembled in a connector, so as to allow the nut to rotate with respect to the other component elements, such as the post and the connector body, of the connector.

Referring still to FIG. 8, the connector may include a post. The post may include a first forward end and an opposing second rearward end. Furthermore, the post may include a flange, such as an externally extending annular protrusion, located at the first end of the post. The flange includes a rearward facing surface that faces the forward facing portion of the nut, when operably assembled in a coaxial cable connector, so as to allow the nut to rotate with respect to the other component elements, such as the post and the connector body, of the connector. The rearward facing surface of flange may be a tapered surface facing the second rearward end of the post.

Further still, an embodiment of the post may include a surface feature such as a lip or protrusion that may engage a portion of a connector body to secure axial movement of the post relative to the connector body. However, the post need not include such a surface feature, and the coaxial cable connector may rely on press-fitting and friction-fitting forces and/or other component structures having features and geometries to help retain the post in secure location both axially and rotationally relative to the connector body. The location proximate or near where the connector body is secured relative to the post may include surface features, such as ridges, grooves, protrusions, or knurling, which may enhance the secure attachment and locating of the post with respect to the connector body.

Moreover, the portion of the post that contacts embodiments of a grounding member may be of a different diameter than a portion of the nut that contacts the connector body. Such diameter variance may facilitate assembly processes. For instance, various components having larger or smaller diameters can be readily press-fit or otherwise secured into connection with each other.

Additionally, the post may include a mating edge, which may be configured to make physical and electrical contact with a corresponding mating edge of the interface port. The post should be formed such that portions of a prepared coaxial cable including the dielectric and center conductor may pass axially into the second end and/or through a portion of the tube-like body of the post.

Moreover, the post should be dimensioned, or otherwise sized, such that the post may be inserted into an end of the prepared coaxial cable, around the dielectric and under the protective outer jacket and conductive grounding shield. Accordingly, where an embodiment of the post may be inserted into an end of the prepared coaxial cable under the drawn back conductive grounding shield, substantial physical and/or electrical contact with the shield may be accomplished thereby facilitating grounding through the post.

The post should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post may include casting, extruding, cutting, turning, drilling, knurling, injection molding, spraying, blow molding, component overmolding, combinations thereof, or other fabrication methods that may provide efficient production of the component.

The coaxial cable connector may include a connector body. The connector body may comprise a first end and opposing second end. Moreover, the connector body may include a post mounting portion proximate or otherwise near the first end of the body, the post mounting portion configured to securely locate the body relative to a portion of the outer surface of post, so that the connector body is axially secured with respect to the post, in a manner that prevents the two components from moving with respect to each other in a direction parallel to the axis of the connector.

The internal surface of the post mounting portion may include an engagement feature that facilitates the secure location of the continuity member with respect to the connector body and/or the post, by physically engaging the continuity member when assembled within the connector. The engagement feature may simply be an annular detent or ridge having a different diameter than the rest of the post mounting portion.

However, other features such as grooves, ridges, protrusions, slots, holes, keyways, bumps, nubs, dimples, crests, rims, or other like structural features may be included to facilitate or possibly assist the positional retention of embodiments of the electrical continuity member with respect to the connector body. Nevertheless, embodiments of the continuity member may also reside in a secure position with respect to the connector body simply through press-fitting and friction-fitting forces engendered by corresponding tolerances, when the various coaxial cable connector components are operably assembled, or otherwise physically aligned and attached together.

In addition, the connector body may include an outer annular recess located proximate or near the first end of the connector body. Furthermore, the connector body may include a semi-rigid, yet compliant outer surface, wherein an inner surface opposing the outer surface may be configured to form an annular seal when the second end is deformably compressed against a received coaxial cable by operation of a fastener member. The connector body may include an external annular detent located proximate or close to the second end of the connector body. Further still, the connector body may include internal surface features, such as annular serrations formed near or proximate the internal surface of the second end of the connector body and configured to enhance frictional restraint and gripping of an inserted and received coaxial cable, through tooth-like interaction with the cable. The connector body may be formed of materials such as plastics, polymers, bendable metals or composite materials that facilitate a semi-rigid, yet compliant outer surface. Further, the connector body may be formed of conductive or non-conductive materials or a combination thereof. Manufacture of the connector body may include casting, extruding, cutting, turning, drilling, knurling, injection molding, spraying, blow molding, component overmolding, combinations thereof, or other fabrication methods that may provide efficient production of the component.

With further reference to FIG. 8, the coaxial cable connector may include a fastener member. The fastener member may have a first end and opposing second end. In addition, the fastener member may include an internal annular protrusion located proximate the first end of the fastener member and configured to mate and achieve purchase with the annular detent on the outer surface of connector body.

Moreover, the fastener member may comprise a central passageway defined between the first end and second end and extending axially through the fastener member. The central passageway may comprise a ramped surface which may be positioned between a first opening or inner bore having a first diameter positioned proximate with the first end of the fastener member and a second opening or inner bore having a second diameter positioned proximate with the second end of the fastener member. The ramped surface may act to deformably compress the outer surface of a connector body when the fastener member is operated to secure a coaxial cable. For example, the narrowing geometry will compress squeeze against the cable, when the fastener member is compressed into a tight and secured position on the connector body.

Additionally, the fastener member may comprise an exterior surface feature positioned proximate with or close to the second end of the fastener member. The surface feature may facilitate gripping of the fastener member during operation of the connector.

Although the surface feature is shown as an annular detent, it may have various shapes and sizes such as a ridge, notch, protrusion, knurling, or other friction or gripping type arrangements. The first end of the fastener member may extend an axial distance so that, when the fastener member is compressed into sealing position on the coaxial cable, the fastener member touches or resides substantially proximate significantly close to the nut. It should be recognized, by those skilled in the requisite art, that the fastener member may be formed of rigid materials such as metals, hard plastics, polymers, composites and the like, and/or combinations thereof. Furthermore, the fastener member may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector may be fastened to a received coaxial cable may also be similar to the way a cable is fastened to a common CMP-type connector having an insertable compression sleeve that is pushed into the connector body to squeeze against and secure the cable. The coaxial cable connector includes an outer connector body having a first end and a second end. The body at least partially surrounds a tubular inner post. The tubular inner post has a first end including a flange and a second end configured to mate with a coaxial cable and contact a portion of the outer conductive grounding shield or sheath of the cable. The connector body is secured relative to a portion of the tubular post proximate or close to the first end of the tubular post and cooperates, or otherwise is functionally located in a radially spaced relationship with the inner post to define an annular chamber with a rear opening. A tubular locking compression member may protrude axially into the annular chamber through its rear opening. The tubular locking compression member may be slidably coupled or otherwise movably affixed to the connector body to compress into the connector body and retain the cable and may be displaceable or movable axially or in the general direction of the axis of the connector between a first open position (accommodating insertion of the tubular inner post into a prepared cable end to contact the grounding shield), and a second clamped position compressibly fixing the cable within the chamber of the connector, because the compression sleeve is squeezed into retraining contact with the cable within the connector body.

It should be understood that when a connector is being installed to a mating port and the center conductor makes contact with the ground path of the port, there may be a signal burst that can make its way into the network and cause speed issues and other network issues. However, in any of the aforementioned connectors, if the nut and/or the grounding member is configured with an axial length such that the grounding member and/or nut can make contact with the external threads of the port before the center conductor makes contact with the port, the signal burst can be prevented, and the signal from the center conductor will be transferred to the interface port.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A coupler for a coaxial cable connector, comprising:

a nut including an internally threaded portion and an extension portion extending forwardly from the threaded portion; and a grounding cage slidingly coupled with the nut;

wherein a forward end of the extension portion includes an annular lip that extends radially inward, and a forward end of the threaded portion defines a rear stop;

wherein the annular lip and the rear stop delimit axial ends of an annular groove in the extension portion;

wherein the grounding cage includes a rear ring portion, a forward ring portion, and a plurality of slats that extend from the rear ring portion to the forward ring portion;

wherein the rear ring portion is disposed in and configured to slide in the annular groove from the annular lip to the rear stop;

wherein the forward ring portion and the plurality of slats are configured to extend forwardly beyond the annular lip to an exterior of the nut such that the forward ring portion is configured to engage an interface port before the nut reaches the interface port when the coupler is coupled with the interface port;

wherein the grounding cage is configured to slide rearward relative to the nut when the extension portion is moved onto the interface port;

wherein the rear stop is configured to limit the rearward movement of the grounding cage relative to the nut; and wherein the annular lip is configured to increase contact pressure on the interface by the grounding cage when the threaded portion is threadingly coupled with the interface port.

2. The coupler of claim 1, wherein the forward ring is an open ring having opposing free ends, and the rear ring is an open ring having opposing free ends such that an opening extends in an axial direction between the opposing free ends of the forward ring and the opposing free ends of the rear ring.

3. A coaxial cable connector comprising:

the coupler of claim 1;

a post coupled with the coupler such that the coupler is configured to rotate relative to the post; and a connector body coupled with the post and configured to be coupled with a coaxial cable.

4. A coupler for a coaxial cable connector, comprising:

a nut including an internally threaded portion and an extension portion extending forwardly from the threaded portion; and a grounding cage slidingly coupled with the nut;

wherein an inner surface of the extension portion includes an annular groove having axial limits defined by an annular lip at a forward end of the extension portion and a forward end of the threaded portion;

wherein the grounding cage includes a rear ring portion disposed in the annular groove and configured to slide in the annular groove between the annular lip and the forward end of the threaded portion;

wherein a forward portion of the grounding cage is configured to extend forwardly beyond the annular lip to an exterior of the nut such that the forward portion is configured to engage an interface port before the nut reaches the interface port when the coupler is coupled with the interface port;

wherein the grounding cage is configured to slide in the annular groove rearward relative to the nut when the extension portion is moved onto the interface port; and wherein the annular lip is configured to increase contact pressure on the interface by the grounding cage when the threaded portion is threadingly coupled with the interface port.

5. The coupler of claim 4, wherein the forward end of the threaded portion defines a rear stop; and wherein the rear stop is configured to limit the rearward movement of the grounding cage relative to the nut.

6. The coupler of claim 4, wherein the grounding cage includes a forward ring portion and a plurality of slats that extend from the rear ring portion to the forward ring portion.

7. The coupler of claim 6, wherein the forward ring portion and the plurality of slats are configured to extend forwardly beyond the annular lip to an exterior of the nut.

8. The coupler of claim 7, wherein the forward ring portion is configured to engage an interface port before the nut when the coupler is coupled with an interface portion.

9. The coupler of claim 6, wherein the forward ring is an open ring having opposing free ends, and the rear ring is an open ring having opposing free ends such that an opening extends in an axial direction between the opposing free ends of the forward ring and the opposing free ends of the rear ring.

10. A coaxial cable connector comprising:

the coupler of claim 4;

a post coupled with the coupler such that the coupler is configured to rotate relative to the post; and a connector body coupled with the post and configured to be coupled with a coaxial cable.

11. A coupler for a coaxial cable connector, comprising:

a nut including an internally threaded portion and an extension portion extending forwardly from the threaded portion; and a grounding cage slidingly coupled with the nut;

wherein an inner surface of the extension portion includes an annular groove;

wherein the grounding cage includes a rear ring portion disposed in the annular groove and configured to slide in the annular groove; and wherein a forward portion of the grounding cage is configured to extend forwardly beyond a forward end of the nut.

12. The coupler of claim 11, wherein the annular groove includes axial limits defined by an annular lip at a forward end of the extension portion and a forward end of the threaded portion.

13. The coupler of claim 12, wherein the rear ring is configured to slide in the annular groove between the annular lip and the forward end of the threaded portion.

14. The coupler of claim 12, wherein the forward end of the threaded portion defines a rear stop; and wherein the rear stop is configured to limit the rearward movement of the grounding cage relative to the nut.

15. The coupler of claim 11, wherein the forward portion of the grounding cage is configured to engage the interface port before the nut reaches the interface port when the coupler is coupled with the interface port.

16. The coupler of claim 11, wherein the annular lip is configured to increase contact pressure on the interface by the grounding cage when the threaded portion is threadingly coupled with the interface port.

17. The coupler of claim 11, wherein the grounding cage includes a forward ring portion and a plurality of slats that extend from the rear ring portion to the forward ring portion.

18. The coupler of claim 17, wherein the forward ring portion and the plurality of slats are configured to extend forwardly beyond the annular lip to an exterior of the nut.

19. The coupler of claim 18, wherein the forward ring portion is configured to engage an interface port before the nut when the coupler is coupled with an interface portion.

20. The coupler of claim 17, wherein the forward ring is an open ring having opposing free ends, and the rear ring is an open ring having opposing free ends such that an opening extends in an axial direction between the opposing free ends of the forward ring and the opposing free ends of the rear ring.

21. The coupler of claim 11, wherein the grounding cage is configured to slide in the annular groove rearward relative to the nut when the coupler is coupled with an interface port.

22. A coaxial cable connector comprising:

the coupler of claim 11;

a connector body configured to be coupled with the coupler and with a coaxial cable.

23. The coaxial cable connector of claim 22, further comprising:

a post configured to be coupled with the coupler and the body such that the coupler is configured to rotate relative to the post and the body.

* * * * *